United States Patent [19]

Spence

[11] 4,317,738

[45] Mar. 2, 1982

[54] DISPERSANTS AND DISPERSANT VISCOSITY MODIFIERS FROM OXIDIZED-SULFURIZED OLEFINS

[75] Inventor: J. Ronald Spence, Bartlesville, Okla.

[73] Assignee: Standard Oil Company (Indiana), Chicago, Ill.

[21] Appl. No.: 196,051

[22] Filed: Oct. 10, 1980

[51] Int. Cl.[3] ..... C10M 1/38

[52] U.S. Cl. ..... 252/47.5; 252/55; 260/125; 260/132

[58] Field of Search ..... 252/47.5, 55, 48.2; 260/132, 125

[56] References Cited

U.S. PATENT DOCUMENTS

| | | | |
|---|---|---|---|
| 2,290,316 | 7/1942 | Cook | 252/47 |
| 2,542,982 | 2/1951 | Bartleson et al. | 252/47 |
| 2,652,367 | 9/1953 | Adelson | 260/132 X |
| 2,924,572 | 2/1960 | Lawrence et al. | 252/47 |
| 3,121,690 | 2/1964 | Berger et al. | 252/25 X |
| 3,364,232 | 1/1968 | Anderson | 252/48.2 X |
| 3,600,327 | 8/1971 | Hu | 252/48.2 X |
| 3,607,748 | 9/1971 | Wilson et al. | 252/55 X |
| 3,687,849 | 8/1972 | Abbott | 252/47.5 |
| 3,928,381 | 12/1975 | Cullen et al. | 252/47.5 X |
| 4,011,380 | 3/1977 | West et al. | 252/55 X |

*Primary Examiner*—Andrew Metz

*Attorney, Agent, or Firm*—Mark Di Pietro; William T. McClain; William H. Magidson

[57] ABSTRACT

Improved dispersants are prepared by oxidizing an olefin and reacting the oxidized olefin with sulfur or a sulfur-yielding compound and an amine.

17 Claims, No Drawings

DISPERSANTS AND DISPERSANT VISCOSITY MODIFIERS FROM OXIDIZED-SULFURIZED OLEFINS

This invention relates to lubricating oil and lubricating oil additives. More particularly this invention relates to dispersants and dispersant viscosity index improvers.

Dispersant viscosity index improvers (dispersant-viscosity modifiers) combine in one additive composition, dispersancy and the ability to improve the viscosity of a lubricant, at high engine temperatures, sufficiently to maintain efficient lubrication.

Dispersancy is the ability of a polar organic chemical to suspend in a lubricant dirt, insoluble combustion by-products and other impurities which otherwise would form harmful deposits on engine surfaces.

A viscosity index improver or viscosity modifier provides sufficient viscosity to a lubricant to insure proper lubrication at elevated engine temperature. Many lubricating oils at ambient temperatures provide substantial viscosity for efficient lubrication. However, at elevated engine temperatures, the oil can lose substantial amount of viscosity and will be unable to form lubricant films that provide efficient lubrication. A viscosity index improver is generally a polymeric material that, in an oil solution at ambient temperatures (about 25° C.), exists in a tightly coiled state which contributes little to viscosity. As the temperature of the oil increases to the operating temperature of the engine (about 135° C.) the polymeric additive uncoils and extends itself in solution. The uncoiled linear nature of the polymer contributes to the viscosity of the lubricating oil in direct relation to the degree of linearity of the polymer. At the operating temperature of an engine the substantially uncoiled linear polymeric material contributes substantial viscosity to the oil insuring lubricant film formation and efficient lubrication.

A variety of dispersants and dispersant viscosity modifiers has been prepared in the past from a variety of organic chemicals. One such material, called an aminated trithione or a sulfurized aminated olefin, is prepared by the reaction of an olefin or polyolefin, sulfur or a sulfur-yielding compound and an amine.

Dispersants are prepared from olefins having relatively low molecular weight up to about 2,000. Dispersant viscosity modifiers are prepared from olefins having a relatively high molecular weight between about 2,000 to 100,000.

These materials have certain drawbacks. While we have found that the aminated sulfurized olefin compositions perform adequately in spark-ignition engines, the performance in diesel engines is not adequate. In the diesel engines the sulfurized aminated olefins fail to provide adequate protection from carbon and lacquer deposits in the engine. Further, during the preparation of the sulfurized aminated olefin dispersant and dispersant viscosity modifiers, a large amount of sulfur is required to fully sulfurize the product. The high level of sulfurization results in a highly colored product, high levels of sulfur concentration in the product, large consumption of sulfur raw materials, and the occasional production of corrosive sulfur species in the oil during storage or use.

Accordingly a need exists to improve the diesel performance of sulfurized aminated olefin dispersants and dispersant viscosity modifiers. A need also exists to improve processes for the preparation of these products by reducing the sulfur charge needed to produce a high quality dispersant.

The general object of this invention is to improve the dispersant properties of sulfurized aminated olefin lubricating oil additives. Another object of the invention is to produce aminated sulfurized olefin dispersants and dispersant viscosity modifier using reduced quantities of sulfur and other reactants. Another object of the invention is to improve the color, dispersancy, viscosity, and other additive properties of the aminated sulfurized olefin product. Other objects hereinafter.

I have discovered that the color, dispersancy, other additive properties and engine carbon and lacquer prevention property of sulfurized aminated olefins can be improved by oxidizing the olefin prior to sulfurization and amination. Apparently the oxidation produces a oxygen-containing intermediate olefin, which is more susceptible to successful sulfurization and amination.

Briefly, the dispersant and dispersant viscosity modifier additives of this invention comprise the reaction product of an olefin, an oxidizing agent, sulfur or a sulfur yielding compound and an amine, which can be formed in the presence of formaldehyde or a formaldehyde-yielding-reagent. The products of this invention are conveniently prepared by oxidizing an olefin or polyolefin to produce an oxidized intermediate product, sulfurizing the oxidized intermediate with sulfur or a sulfur-yielding compound to yield the sulfurized-oxidized olefin and aminating the sulfurized oxidized olefin to produce the desired additive composition.

Olefins useful in the preparation of the oxidized, sulfurized aminated olefin additives of this invention comprise unsaturated hydrocarbons including mono- or polyunsaturated olefinic hydrocarbons recovered from refinery streams, polyolefins, etc. These olefins include decene, tertiary decene, 2-decene, dodecene, eicosene, triacontene, pentacontene, hectene, etc. Substantially atactic, amorphous or viscous polyolefins produced by the polymerization of low molecular weight olefin monomers are also useful in the preparation of the additive products. The polyolefins can be obtained by contacting an olefin or mixtures of olefins generally in liquid phase with the catalyst such as sulfuric acid, boron trifluoride, aluminum chloride, Ziegler-Natta or other similar catalysts well known in the art. Preferably, olefinic polymers can be derived from ethene (ethylene), propene (propylene), 1-butene, 2-butene, isobutylene (2-methyl-propene), or nonconjugated or conjugated dienes such as butadiene or 5-ethylene-2-norborene, etc. Preferred amorphous polymers include polypropylene, an ethylene-propylene copolymer, an ethylene-propylene-diene terpolymer, an ethylene-propylene-5-ethylidene-2-norborene terpolymer, an ethylene-propylene-5-methylidene-2-norborene terpolymer, polyisobutylene, poly-1-butene, poly-2-butene, etc., and mixtures thereof. The olefin or polyolefin can have a molecular weight from about 150 to about 140,000 or greater. Preferably polymers having a molecular weight from about 300 to about 100,000 are useful for reasons of economy, reactivity, and availability.

Dispersant viscosity index improving polymers are generally prepared from polymers having a molecular weight of at least about 2,000 to about 100,000. Preferably ethylene-propylene and ethylene-propylene-5-ethylidene-2-norbornene polymers having a molecular weight between about 2,500 and 50,000 produce highly effective dispersant viscosity index improving additives.

Sulfur-yielding compounds useful for producing the oxidized aminated sulfurized olefins of this invention include solid, particulate, or molten forms of elemental sulfur or sulfur-yielding compounds such as sulfur, sulfur monochloride, sulfur dichloride, hydrogen sulfide, phosphorus pentasulfide, etc. Fine particulate or molten elemental sulfur is preferred for reasons of ease of handling, high reactivity, availability, and low cost.

Oxidizing agents which can be used to oxidize the olefinic compounds are conventional oxidizing agents. Any oxygen containing material capable of releasing oxygen atoms or molecules under oxidizing conditions can be used. Examples of oxidizing agents which can be used under suitable conditions of temperature, concentration and pressure include oxygen, air, sulfur oxides such as sulfur dioxide, sulfur trioxide, etc., nitrogen oxides including nitrogen dioxide, nitrogen trioxide, nitrogen pentoxide, etc., peroxides such as hydrogen peroxide, sodium peroxide, percarboxylic acids and ozone. Other suitable oxidizing agents are the oxygen-containing gases such as various mixtures of oxygen, air, inert gases such as noble gases, nitrogen, etc. Air, air with added oxygen or diluted air with reduced oxygen concentration containing less than the naturally occurring amount of oxygen are the preferred agents for reasons of economy, availability, and safety.

Amines useful in preparing the aminated sulfurized olefins of this invention include aliphatic amines, polyamines having a general formula $NH_2(CH_2)_yNH_2$ wherein y is an integer of 2 to 12, and polyalkylene polyamines of the general formula $NH_2[(CH_2)_z\text{-}NH]_xH$, wherein z is an integer of 2 to 6 and x is an integer of 1 to 10. Illustrative of suitable amines are methylamine, butylamine, cyclohexylamine, propylamine, decylamine, ethylenediamine, trimethylenediamine, tetramethylenediamine, hexamethylenediamine, ethylenediamine, diethylenetriamine, triethylenetetraamine, tetraethylenepentamine, hexamethylenediamine, tripropylenetetraamine, tetrapropylenepentamine, and other polyalkylene polyamines in which the alkyl group contains about 12 carbon atoms or less. Other useful polyamines include bis(aminoalkyl)piperazine, bis(aminoalkyl)ethylenediamine, bis(aminoalkyl)propylene diamine, N-amino-alkyl-morphylene, 1,3-propane polyamines, and polyoxy polyamines.

Optionally, formaldehyde or formaldehyde yielding reagents can be used to promote the amination reaction including, for example, formaldehyde, formalin, paraformaldehyde, trioxane, etc.

In somewhat greater detail, the novel products of this invention can be produced by first oxidizing and sulfurizing the olefin or polyolefin and then reacting the oxidized-sulfurized product with an amine. The oxidation of the sulfurization can be carried out in any order. However, to afford reaction control and an improved product, the following reaction sequence is preferred: (a) oxidizing the olefin or polyolefin to produce an oxidized intermediate product; (b) reacting the oxidized intermediate product with sulfur to produce an oxidized sulfurized product; and (c) reacting the oxidized sulfurized product with an amine compound, optionally in the presence of formaldehyde or a formaldehyde-yielding compound, to produce the additives of the invention.

The olefins or polyolefins of this invention can be oxidized as a first step in the production of the lubricant additives according to U.S. Pat. Nos. 3,872,019 and 4,011,380, both of which disclose the oxidation of olefinic polymers for the production of lubricating oil additives. The oxidation can be accomplished by contacting the olefin or polyolefin under suitable conditions of temperature and pressure with an oxidizing agent such as air or free oxygen or any other oxygen-containing material, optionally mixed with a diluent or inert gas, capable of releasing oxygen under oxidation conditions. If desired, the oxidation can be conducted in the presence of known oxidation catalysts, such as platinum or platinum group metals, and compounds containing metals such as copper, iron, cobalt, cadmium, manganese, vanadium, benzene sulfonic acids, etc. Other oxidation processes are disclosed in U.S. Pat. Nos. 2,982,723; 3,316,177; 3,153,025; 3,365,499; and 3,544,520.

Generally, the oxidation can be carried out over a wide temperature range, depending on the oxidizing agent used; for example, with an active oxidizing agent hydrogen peroxide, temperatures in the range of −40° F. to 400° F. have been used, while the less active oxidizing agents, for example air or air diluted with nitrogen or process gas, temperatures in the range of 100°–800° F. have been successfully used. The copolymers are generally dissolved in oil or other inert solvents prior to oxidation. Further, depending on the rate desired, the oxidation can be conducted at subatmospheric, atmospheric, or superatmospheric pressures, and in the presence of or absence of oxidation catalysts. The conditions of temperature, pressure, oxygen content of the oxidizing agent the rate of introduction of the oxidizing agent, and catalyst employed, can be correlated and controlled by those skilled in the art to obtain an optimum degree of oxidation as determined by desired molecular weight and the dispersancy of the final product.

Inert diluents useful in the oxidation include liquids stable to oxidation at elevated temperature include lubricating oil fractions, polyisobutylene, etc. Preferably, the polymer is dissolved or suspended at a concentration of about 2 to 70 weight percent of the polymer in oil so that solution is not too viscous to be handled. Commonly, the polymer solution can have a viscosity of from about 2,000–50,000 SUS at 100° F. The polymer solution in inert solvent such as oil can be mechanically degraded to adjust molecular weight. Often dispersant viscosity index improvers are mechanically degraded prior to oxidation, sulfurization and amination to a molecular weight of from about 2,500 to about 50,000. The polymer oil solution can also be mechanically degraded at any convenient step during the production to form a solution having a viscosity corresponding to the desired molecular weight for optimum viscosity modification in an oil.

The polymer oil solution is contacted with the oxygen-containing oxidizing agent, preferably comprising air or air diluted with nitrogen at an elevated temperature comprising from about 100°–400° F. The rate of addition of oxidizing agent to the polymer oil solution is controlled so that the oxidation occurs at the controlled rate and combustion does not occur. The oxidation of the polymer commonly degrades the molecular weight of the polymer and reduces solution viscosity. The degree of oxidation can conveniently be monitored by measuring solution viscosity. However, if a viscosity modifier is desired the oxidation cannot be continued to the extent that the viscosity and the molecular weight of this polymer is reduced to the point that the molecular weight of polymer drops substantially below about 2500.

The oxidized product can be sulfurized by contacting the oxidized olefin with about 0.1–20 moles of sulfur or sulfur-yielding per mole of olefin compound originally in the solution. High quality material can be made by reacting sulfur and the oxidized copolymers in a ratio so that there are about one sulfur atom per each 50–150 polymer carbon atoms, preferably one sulfur atom per 100–120 polymer carbons. Greater amounts of sulfur result in undesirable viscosity increase, dark color, and reduced dispersancy. Lesser amounts of sulfur reduce reactivity with the amine and produce low quality dispersant.

The temperature range of the sulfurization is generally about 50°–500° C., preferably for reduced polymer degradation and high quality sulfurization the reaction is run at about 100°–250° C. Frequently sulfurization can be performed in the presence of catalysts added to the reaction to increase yield and rate of reaction. These catalysts include acidified clays, paratoluene sulfonic acid, a dialkyl phosphorodithioic acid, and a phosphorus sulfide. The time required to complete sulfurization will vary depending on the ratios of reactants, reactant temperature, catalyst use and purity of reagents. The course of reaction can conveniently be monitored by following reaction vessel pressure or hydrogen sulfide evolution. The reaction can be considered complete when pressure levels off when evolution of hydrogen sulfide declines. Commonly, the reaction is run under an inert gas atmosphere, e.g., nitrogen, to prevent subsequent oxidation of the reaction product. At the end of the sulfurization, the product can conveniently be stripped of volatile materials and filtered of particulate matter.

The sulfurized-oxidized material is converted into a dispersant by means of reaction with amine optionally, to promote the amination, in the presence of formaldehyde or a formaldehyde-yielding reagent. The sulfurized-oxidized olefin can be reacted with from about 0.5–10 moles of an amine per mole of olefin originally charged. The amination reaction is commonly performed at a temperature between about 50°–400° C., preferably a temperature of about 150°–200° C. for reasons of ease reaction, and low degradation of products. While the reaction time is variable depending on purity, concentration of ratio of reactants, the reaction is commonly complete at about 2–24 hours. Volatile and particulate materials can be conveniently removed at this point. The amination can be promoted by the presence of formaldehyde or a formaldehyde-yielding reagent. Formaldehyde also reacts with free amino groups which often can be deposit precursors or corrosive in the engine into non-corrosive dispersant moieties. Commonly, from about 0.5 to about 10 moles of formaldehyde or formaldehyde-yielding compound can be added per mole of amine. Preferably, from about 1 to 2.5 moles of formaldehyde or formaldehyde-yielding compound is added per mole of amine for reasons of efficient reaction and low consumption of reactants. The reaction of the amine, formaldehyde and the sulfurized-oxidized material can be conveniently monitored by observing the 1720 $CM^1$ band in the infrared (IR) spectra. The reaction can be considered essentially complete when the band has substantially disappeared.

Both the sulfurization and amination reaction can produce great quantities of tarry or charred byproducts which can contaminate the product and hinder filtration and other purification steps.

The removal of tarry byproducts of the olefin-sulfur-amine reaction can be promoted by performing the amination or sulfurization reaction in the presence of an alkali metal or an alkaline earth metal compound. About 0.01–20 moles of the alkali metal or alkaline earth metal compound per mole of amine can be added to the reaction mixture simultaneously with the sulfur or sulfur-yielding compound or the amine. Sodium hydroxide, lithium chloride, potassium chloride, calcium oxide, calcium hydroxide, magnesium oxide, or magnesium hydroxide, barium hydroxide, calcium carbonate, barium chloride, etc. can be added to the reaction mixture to reduce the tarry material. Apparently, the alkali metal or alkaline earth metal compounds react with or absorb the tarry reaction byproducts and reduce the sticky-tacky character of the tarry material. The tarry-metal oxide product then precipitates and can be easily removed by washing, filtration or centrifugation.

Commonly, the alkali metal or alkaline earth metal compound can be added simultaneously with the amine, prior to the amine, or after the amine. However, the best results are obtained when the alkaline earth metal is added prior to or simultaneously with the amine compound.

The reaction products of this invention are effective in lubricant compositions when used in amounts of about 0.1 to 10 weight percent based on the oil. Suitable lubricating base oils are mineral oils, petroleum oils, synthetic lubricating oils, and natural lubricating oils of animal or vegetable origin. Concentrates of the additive in appropriate base oils containing 10 to 90 weight percent of the additive based on the oil are convenient for producing finished lubricants by dilution with additional base oil. A variety of other additives can be used beneficially with the additive of this invention, including antioxidants, dispersants, corrosion inhibitors, wear inhibitors, friction modifiers, detergents, antibacterial agents, antifoam agents, etc.

Lubricants containing petroleum additives are commonly evaluated in the standard VD automotive engine test, the 1H2 catepillar engine test, the Amihot Test, the Hot Tube Test, and the Spot Dispersancy Test. In the VD and 1H2 engine tests, lubricants containing the experimental additives are charged respectively to a standard internal combustion engine and to a diesel engine. The engines are operated at an assigned load and temperature, and at the end of a prescribed time the engines are disassembled and examined for deposits and wear. These engine tests are standard methods well known in the industry.

In the Spot Dispersancy Test, the ability of the additive in the lubricating oil to suspend and disperse engine sludge is tested. To perform this test, an amount of engine sludge produced in a VC or VD engine test is added to a small amount of lubricant containing the additive to be tested. The sludge-lubricant mixture is incubated in an oven at 146° C. for 24 hours. After this period, the mixture is spotted on a clean white blotter paper. The oil diffuses through the blotter paper carrying the sludge to some extent, depending on the dispersancy of the additive, forming an oil diffusion ring and a sludge diffusion ring. The dispersancy of the additive is measured by comparing the ratio of the diameter of the oil ring to the diameter of the sludge diffusion ring. The diameter of the sludge ring is divided by the diameter of the oil ring, and the result is multiplied by 100 percent dispersancy. The higher the number the better dispersant property of the additive.

In the Hot Tube Test, the high temperature varnish inhibiting properties of the additive is measured. A measured portion of the lubricating oil containing the additive in question is slowly metered into a two millimeter glass tube heated in an aluminum block. Through the tube is passed either nitrogen oxides or air at 201.7° C. (395° F.) or 257.2° C. (495° F.). During the test, the oil is consumed, and the ability of the additive to prevent the formation of varnish deposits is measured by the ability of the additive to prevent formation of colored deposits on the interior surface of the tube. The tube is rated 10 to 1 wherein 10 is perfectly clean and colorless and 1 is opaque and black.

In the Amihot Test, bearing material containing copper and lead is placed in a tube containing a portion of lubricating oil containing the test additive product. To the oil is added a small amount of corrosive material such as hydrochloric acid or alkylene dihalide. The lubricant and bearing material are heated in the tube to a temperature of 162.8° C. (325° F.), and air is passed through the tube. The bearing is weighed prior to imersion in the oil, and at the end of the test after cleaning the solvent. The ability of the additive to prevent corrosion of the bearing material is reflected in the loss of weight of bearing material during contact with the lubricating oil containing the corrosive material. The smaller the weight loss the better the additive is preventing acidic corrosion.

The following examples are illustrative of methods used in the preparation and the application of the additives of this invention. The examples and data should not be used to unduly limit the scope of the invention.

EXAMPLE I

Into a 12-liter, three-neck reaction flask equipped with a mechanical stirrer, reflux condenser, air inlet tube and nitrogen inlet tube was placed 4650 grams of 110 neutral oil. The oil was stirred and heated to a temperature of 360° F. under a nitrogen atmosphere. Into the heated oil was added 350 grams (0.01 mole) of an ethylene-propylene-5-ethylidene-2-norbornene polymer having a molecular weight of about 35,000. The mixture was maintained at 360° F. under the nitrogen atmosphere until the polymer was dissolved and the solution was homogeneous. Into the homogeneous solution was added 10 grams of an overbased magnesium alkyl benzene sulfonate. Air was then sparged through the mixture at a rate of 1,600 milliliters per minute to oxidize and degrade the polymer. The viscosity of the solution as a function of time was monitored. Initially the viscosity was about 12,000 SUS @ 210° F. and the oxidation reaction was terminated when the solution viscosity reached about 2,000 SUS at 210° F.

6,000 grams of an oxidized polymer similar to that prepared above was heated to a temperature of 185° C. with stirring under a nitrogen atmosphere, and about 10.8 grams (0.34 moles) of elemental sulfur were added slowly to the hot polymer oil solution. The temperature was raised to about 220° C., and the generation of hydrogen sulfide was monitored with a wet test meter. The material was sulfurized in this manner for about 3.5 hours. The temperature was raised at the end of this time to 235° C., and the mixture was stripped with nitrogen to remove volatile materials. Viscosity of the final product was in the range of 1,750–2,050 SUS.

Into a 12-liter, three-neck flask equipped with a mechanical stirrer, reflux condenser nitrogen inlet tube and heater were added 6,000 grams of the sulfurized-oxidized polymer oil solution prepared above. The mixture was stirred and heated to a temperature of 180° C. under nitrogen, and 60 grams of $C_{20}$ sulfonic acid (34 millimoles) and 39 grams (0.34 moles) of hexamethylene diamine were added followed by the dropwise addition of 57 grams (0.70 moles) of a 37 weight percent aqueous formaldehyde solution. The solution maintained at 180° C. with stirring for a period of one hour. At the end of this time, excess amine and water and other volatile materials were stripped from the reaction flask with a stream of nitrogen. The final product was filtered through celite.

EXAMPLE II

Into a 12-liter, three-neck reaction flask equipped with a mechanical stirrer, reflux condenser, and nitrogen inlet tube was added 2700 gms (0.0675 mole) of an ethylene-propylene amorphous polymer having a molecular weight of about 40,000, and 723 gms (0.3375 mole) polyisobutylene having a molecular weight of about 2240. The mixture was stirred and heated to 180° C., and 77.86 grams (2.43 moles) of sulfur was added. The temperature was raised to 230° C., and hydrogen sulfide evolution was measured. After reaction at 230° C. for 5 hours the mixture was stripped with nitrogen to remove volatile material.

To the above sulfurized product was added 44.65 gms (0.23 moles) of tetraethylenepentamine, 70 gms magnesium hydroxide, 50 milliliters of water and 250 milliliters of xylene. The mixture was stirred and heated to 165° C. as water was removed azeotropically. The mixture as maintained at 165° C. for 5 hours, was stripped of volatiles and was filtered.

EXAMPLE III

Into an autoclave was added 1320 gms (0.33 mole) of an ethylene-propylene copolymer having a molecular weight of about 4000, 3400 gms (1.5 moles) of a polyisobutylene polymer having a molecular weight of about 2240 and 13200 gms of 5W oil. The mixture was stirred and heated until the polymers dissolved and the solution became uniform.

To 1000 gms (0.1 mole of polymer) of the above polymer-oil solution at 165° C. was added 19.82 gms (0.6 mole) sulfur. The mixture was stirred and heated to 230° C. and the evolution of hydrogen sulfide gas was monitored with a wet test meter. At the end of 5 hours at 230° C., the mixture was stripped of volatiles and was filtered.

To the sulfurized polymer-oil solution prepared above was added 11.47 gms (0.061 mole) of tetrethylenepentamine, 20.00 gms magnesium hydroxide, 20 milliliters water and 80 milliliters of xylene. The mixture was stirred and heated to 165° C. as water was removed azeotropically. The mixture was maintained at 165° C. for 5 hours. At the end of this period the mixture was diluted with heptane, was filtered and was stripped.

To the aminated sulfurized polymer-oil solution was added 3.75 gms (0.01 mole) of $H_3BO_3$ and 19.7 gms (0.24 moles) 37% aqueous formalin. The mixture was heated to 85° C. and water was removed azeotropically. After maintaining the mixture at 85° C. for 0.5 hour, the mixture was stripped at 185° C. and was filtered.

EXAMPLE IV

Into a 5-liter reaction flask equipped with a nitrogen inlet tube, air inlet tube, stirrer, heater and hydrogen sulfide meter was added 354 grams (0.01 mole) of an ethylene-propylene-5-ethylidene-2-norbornene terpolymer (number average molecular weight of 35,000), 10 grams overbased magnesium sulfonate, and 10 grams $C_{20}$ sulfonic acid. The contents of the flask was mixed and heated to about 365° F. The heated contents was sparged with air as as oxidizing agent, at 1600 ml/min and nitrogen gas at 1600 ml/min. The viscosity of the mixture prior to air injection was 12499 SSU @ 210° F. After 2 hours the viscosity was 1875 SSU @ 210° F. indicating sufficient oxidation.

1000 gms of an oxidized polymer solution similar to the product prepared above was stirred and heated to about 185° C. and 3.7 gms (0.12 mole or one atom of sulfur per 56 polymer carbon atoms) of sulfur was added. The mixture was stirred and heated to 220° C. and the evolution of hydrogen sulfide was monitored with a wet test meter. After 4.25 hours at 220° C. the mixture was stripped and filtered.

EXAMPLE V

Example IV was repeated except with 1.8 gms (0.06 mole or one atom sulfur per 112 atoms of polymer carbon) of sulfur in place of the 3.7 gms of sulfur.

EXAMPLE VI

Example IV was repeated except with 6.7 grams (0.21 mole or one atom sulfur per 30 atoms polymer carbon) of sulfur in place of the 3.7 gms of sulfur.

EXAMPLE VII

To a 1-liter reaction flask equipped with a stirrer, reflux condenser, nitrogen atmosphere and heater was added 200 grams of product of Example IV, 2.0 gms $C_{20}$ alkylbenzene sulfonic acid, 1.3 gms (0.11 mole) hexamethylene diamine, and 1.9 gms (0.025 mole) of 37 wt.% aqueous formalin. The mixture was stirred and heated under nitrogen to 180° for 1 hour. The mixture was then stripped and filtered.

EXAMPLE VIII

Example VII was repeated except that the 200 grams of the product of Example V was used in place of the 200 grams of the product of Example IV.

EXAMPLE IX

Example VII was repeated except that 200 grams of the product of Example VI was used in place of the 200 grams of the product of Example IV.

TABLE I

| | TEST OIL FORMULATION (Wt. %) | | | |
|---|---|---|---|---|
| | A | B | C | D |
| PRODUCT OF EXAMPLE I | 14.7 | 7.50 | — | — |
| PRODUCT OF EXAMPLE II | — | — | 15.0 | — |
| PRODUCT OF EXAMPLE III | — | — | — | 6.80 |
| Zinc dialkyl dithiophosphate | 1.55 | 1.75 | 1.5 | 1.75 |
| OVerbased Magnesium Sulfonate | 0.90 | 0.90 | 0.90 | 0.90 |
| Mannich Dispersant | 2.00 | — | — | — |
| Overbased Calcium Phenate | 0.70 | 0.50 | 0.70 | 0.48 |
| Methacrylate Polymer VI Improver | 0.50 | 0.50 | — | 0.40 |
| SX-5 Oil | 48.10 | — | 49.10 | — |

TABLE I-continued

| | TEST OIL FORMULATION (Wt. %) | | | |
|---|---|---|---|---|
| | A | B | C | D |
| SX-10 Oil | 31.55 | — | 32.80 | — |
| 100 N Oil | — | 43.67 | — | 43.67 |
| 330 N Oil | — | 45.18 | — | 46.00 |

TABLE II

| ENGINE TESTS | | |
|---|---|---|
| | VD TEST OIL A (oxidized-sulfurized) | TEST OIL C (sulfurized) |
| AVERAGE SLUDGE | 9.60 | 9.61 |
| PISTON VARNISH | 7.33 | 7.08 |
| AVERAGE VARNISH | 7.41 | 6.76 |
| | IH2 TEST OIL B (oxidized-sulfurized) | TEST OIL D (sulfurized) |
| | @ 120 Hours | |
| TOP GROOVE FILL (TGF) | 4% | 19 |
| WEIGHTED CARBON DEMERITS (WCD) | 24 | 83 |
| WEIGHTED TOTAL DEMERITS (WTD) | 25 | 157 |
| | @ 480 Hours | |
| TGF | 15% | FAILED TEST |
| WCD | 104 | DID NOT |
| WTD | 105 | FINISH |

TABLE III

| COLOR OF SULFURIZED PRODUCTS | | |
|---|---|---|
| | ASTM ABSOLUTE COLOR | RATIO SULFUR ATOMS: CARBON ATOMS |
| EXAMPLE IV | 40 | 1:112 |
| EXAMPLE V | 90 | 1:56 |
| EXAMPLE VI | 190 | 1:28 |

TABLE IV

| BENCH TESTS OF AMINATED SULFURIZED-OXIDIZED PRODUCTS | | |
|---|---|---|
| | AMIHOT Pb Corrosion (mg) | Cu Corrosion (mg) |
| PRODUCT EX. VII | −2.3 | −0.3 |
| PRODUCT EX. VIII | −4.0 | −0.4 |
| PRODUCT EX. IX | −4.0 | −0.4 |
| | HTT Rating | |
| PRODUCT EX. VII | 3 | |
| PRODUCT EX. VIII | 2 | |
| PRODUCT EX. IX | 1 | |

| SPOT DISPERSANCY TEST (%) | | | |
|---|---|---|---|
| PRODUCT EX. | VII | VIII | IX |
| @ 5% in test oil | 82 | 82 | 81 |
| @ 10% | 89 | 90 | 91 |
| @ 15% | 92 | 93 | 95 |

An examination of the tables shows that the oxidized, sulfurized aminated product had substantially improved performance in the VD test, particularly in the average varnish measurement when compared to the nonoxidized product. In the IH2 test the oxidized, sulfurized aminated product passed while the nonoxidized sulfurized aminated product failed the test.

Tables III and IV shows that using an oxidized polymer to produce the dispersant permits a reduction in sulfur charge producing a lighter colored product having properties equivalent to products made with high sulfur charges.

Since the invention can be used in many embodiments, the invention resides solely in the claims appended hereinafter.

I claim:

1. An improved dispersant having an improved color and resistance to formation of engine deposits which comprises the reaction product of an olefin having a molecular weight of 2500–100,000, an oxidizing agent capable of releasing oxygen atoms or molecules under oxidizing conditions such that the molecular weight of the olefin is not reduced substantially below 2500, about 0.1 to 20 moles of sulfur or a sulfur-yielding compound per mole of olefin and about 0.5 to 10 moles of a polyamine per mole of olefin, at a temperature between about 50° to 500° C.

2. The improved dispersant of claim 1 further comprising preparing the reaction product in the presence of an amination promoting amount of formaldehyde or a formaldehyde-yielding reagent.

3. The improved dispersant of claim 2 wherein the formaldehyde-yielding reagent is formalin, trioxane, paraformaldehyde or mixtures thereof.

4. The improved dispersant of claim 1 wherein the olefin comprises a substantially amorphous polyolefin.

5. The improved dispersant of claim 4 wherein the substantially amorphous polyolefin is, polypropylene, an ethylene-propylene copolymer, an ethylene-propylene-diene terpolymer or mixtures thereof.

6. The improved dispersant of claim 5 wherein the ethylene-propylene-diene polymer is ethylene-propylene-5-ethylidene-2-norborene terpolymer or ethylene-propylene-5-methylidene-2-norborene terpolymer.

7. The improved dispersant of claim 1 wherein the polyamine comprises a polyalkylene polyamine.

8. The improved dispersant of claim 7 wherein the polyalkylene polyamine is ethylenediamine, diethylenetriamine, triethylenetetramine, tetraethylenepentamine, hexamethylenediamine, or mixtures thereof.

9. An improved dispersant having improved color and resistance to engine deposit formation which comprises the product of the reaction of contacting an olefin having a molecular weight of 2500–100,000 with an oxidizing agent capable of releasing oxygen atoms or molecules under oxidizing conditions such that the molecular weight of the olefin is not reduced substantially below 2500, to form an oxidized intermediate, contacting the oxidized intermediate with about 0.1 to 20 moles of sulfur or a sulfur-yielding compound to form an oxidized sulfurized product, and contacting the oxidized sulfurized product with about 0.5 to 10 moles of a polyamine per mole of olefin, at a temperature of about 50° to 500° C.

10. The improved dispersant of claim 9 wherein the oxidizing agent comprises an oxygen-containing gas.

11. The improved dispersant of claim 9 wherein the polyamine comprises a polyalkylene polyamine.

12. The improved dispersant of claim 11 wherein the polyalkylene polyamine is ethylenediamine, diethylenetriamine, triethylenetetraamine, tetraethylenepentamine, hexamethylenediamine, or mixtures thereof.

13. The improved dispersant of claim 9 wherein the olefin comprises a substantially amorphous polyolefin.

14. The dispersant of claim 9 wherein the substantially amorphous polyolefin is polypropylene, an ethylene-propylene copolymer, an ethylene-propylene-diene terpolymer, or mixtures thereof.

15. The improved dispersant of claim 14 wherein the ethylene-propylene-diene polymer is an ethylene-propylene-5-ethylidene-2-norborene terpolymer or a ethylene-propylene-5-methylidene-2-norborene terpolymer.

16. The dispersant of claim 9 further comprising contacting the polyamine with the oxidized sulfurized product in the presence of an amination promoting amount of formaldehyde or a formaldehyde yielding reagent.

17. A lubricant composition comprising a major proportion of a lubricating base oil and about 0.1 to 10 weight percent based on the oil of the product of claim 1 or 9.

* * * * *

UNITED STATES PATENT OFFICE

CERTIFICATE OF CORRECTION

Patent No. 4,317,738 Dated March 2, 1982

Inventor(s) J. Ronald Spence

It is certified that error appears in the above-identified patent and that said Letters Patent are hereby corrected as shown below:

| Patent Column | Line | |
|---|---|---|
| 2 | 53 & 54 | "ethylene-propylene-5-ethylidene-2-norborene" should read --ethylene-propylene-5-ethylidene-2-norbornene--. |
| 2 | 54 & 55 | "ethylene-propylene-5-methylidene-2-norborene" should read --ethylene-propylene-5-methylidene-2-norbornene--. |
| 3 | 37 | "triethylenetetraamine" should read --triethylenetetramine--. |
| 3 | 38 & 39 | "tripropylenetetraamine" should read --tripropylenetetramine--. |
| 5 | 45 | "ease reaction" should read --ease of reaction--. |
| 6 | 43 | "catepillar" should read --Caterpillar--. |
| 8 | 2 | "condenser nitrogen" should read --condenser, nitrogen--. |
| 8 | 7 & 8 | "hexamethylene diamine" should read --hexamethylenediamine--. |
| 9 | 40 | "hexamethylene diamine" should read --hexamethylenediamine--. |
| 9 | 63 | "OVerbased" should read --Overbased--. |
| 11 | 38 & 39 | "ethylene-propylene-5-ethylidene-2-norborene" should read --ethylene-propylene-5-ethylidene-2-norbornene--. |

UNITED STATES PATENT OFFICE

CERTIFICATE OF CORRECTION

Patent No. 4,317,738 Dated March 2, 1982

Inventor(s) J. Ronald Spence

It is certified that error appears in the above-identified patent and that said Letters Patent are hereby corrected as shown below:

| Patent Column | Line | |
|---|---|---|
| 11 | 39 & 40 | "ethylene-propylene-5-methylidene-2-norborene" should read --ethylene-propylene-5-methylidene-2-norbornene--. |
| 12 | 23 | "triethylenetetraamine" should read --triethylenetetramine--. |
| 12 | 32 & 33 | "ethylene-propylene-5-ethylidene-2-norborene" should read --ethylene-propylene-5-ethylidene-2-norbornene--. |
| 12 | 33 & 34 | "ethylene-propylene-5-methylidene-2-norborene" should read --ethylene-propylene-5-methylidene-2-norbornene--. |

Signed and Sealed this

Sixteenth Day of November 1982

[SEAL]

Attest:

GERALD J. MOSSINGHOFF

Attesting Officer

Commissioner of Patents and Trademarks